US011597060B2

(12) United States Patent
Chang

(10) Patent No.: US 11,597,060 B2
(45) Date of Patent: Mar. 7, 2023

(54) TORQUE-ADJUSTABLE PNEUMATIC TOOL

(71) Applicant: Airboss Air Tools Co., Ltd., Taichung (TW)

(72) Inventor: Hsin He Chang, Taichung (TW)

(73) Assignee: Airboss Air Tools Co., Ltd., Taichung (TW)

( * ) Notice: Subject to any disclaimer, the term of this patent is extended or adjusted under 35 U.S.C. 154(b) by 1060 days.

(21) Appl. No.: 16/273,466

(22) Filed: Feb. 12, 2019

(65) Prior Publication Data

US 2020/0254594 A1 Aug. 13, 2020

(51) Int. Cl.

| | |
|---|---|
| ***B25B 21/00*** | (2006.01) |
| *B24B 45/00* | (2006.01) |
| *B25F 5/00* | (2006.01) |

(52) U.S. Cl.

CPC ..... *B25B 21/005* (2013.01); *B24B 45/006* (2013.01); *B25F 5/00* (2013.01)

(58) Field of Classification Search

CPC ..... B25B 21/005; B24B 45/006; B25F 5/00
See application file for complete search history.

(56) References Cited

U.S. PATENT DOCUMENTS 5,918,686 A * 7/1999 Izumisawa ..... F16K 11/07 173/221
6,135,213 A * 10/2000 Schoeps ..... B25B 21/00 173/93.5
7,238,095 B1 * 7/2007 Sun ..... B24B 23/026 451/344
8,955,614 B2 * 2/2015 Schoeps ..... B25B 21/00 181/267
2017/0312899 A1 * 11/2017 Jansson ..... B25B 21/02
2019/0061134 A1 * 2/2019 Sun ..... B25C 1/047

FOREIGN PATENT DOCUMENTS

| | | |
|---|---|---|
| CN | 2168688 | 6/1994 |
| CN | 1727124 A | 2/2006 |
| TW | M270005 | 7/2005 |
| TW | M278521 | 10/2005 |
| TW | 200934620 | 8/2009 |

* cited by examiner

*Primary Examiner* — Andrew M Tecco
*Assistant Examiner* — Nicholas E Igbokwe
(74) *Attorney, Agent, or Firm* — Bradley J. Thorson; DeWitt LLP

(57) ABSTRACT

A torque-adjustable pneumatic tool comprises a body, a trigger assembly, and a torque-adjusting module. The body has an outlet tunnel. The trigger assembly is mounted to the body. The torque-adjusting module is mounted to the body, communicates with the outlet tunnel, and has a silencer, an adjusting bolt, and a piston lid. The silencer has a recess and an exhaust portion communicating with the recess. The exhaust portion has a threaded hole and at least one exhaust hole that are separately disposed through the exhaust portion. The adjusting bolt is movably mounted to the threaded hole of the silencer from a side away from the body, and engages with the silencer through threads. The piston lid is fixed to the adjusting bolt and is able to enter the recess.

8 Claims, 15 Drawing Sheets

TORQUE-ADJUSTABLE PNEUMATIC TOOL

BACKGROUND OF THE INVENTION

1. Field of the Invention

The present invention relates to a pneumatic tool, and more particularly to a torque-adjustable pneumatic tool that may change output torques by simple operation.

2. Description of Related Art

With reference to FIG. 16, a conventional pneumatic tool 90 comprises a body 91, a driving element 92, a trigger assembly 93, and a silencer 94. The body 91 has a holding chamber 911, a trigger chamber 912 communicating with the holding chamber 911, an inlet tunnel 913 communicating with the trigger chamber 912, and an outlet tunnel 914. The outlet tunnel 914 communicates with the trigger chamber 912 and is separated from the inlet tunnel 913. The driving element 92 is mounted in the holding chamber 911. The trigger assembly 93 is mounted in the trigger chamber 912. The silencer 94 is connected to a bottom of the body 91 and communicates with the outlet tunnel 914.

A user may connect the conventional pneumatic tool 90 and a compressor, so compressed air may enter the body 91 via the inlet tunnel 913. Once the trigger assembly 93 is pressed by the user, the compressed air may flow through the holding chamber 911 to actuate the driving element 92, and further be exhausted from the outlet tunnel 914 of the body 91 and the silencer 94. Throughout this process, the conventional pneumatic tool 90 may be used to provide a required rotation speed and a required torque.

However, the conventional pneumatic tool 90 has the following shortcoming

With reference to FIG. 16, the only way to change the flow of the compressed air is to press the trigger assembly 93, which may merely control whether the compressed air enters the holding body 911 or not. As a result, the user cannot adjust the output torque and the rotation speed by operating the conventional pneumatic tool 90.

SUMMARY OF THE INVENTION

The main objective of the present invention is to provide a torque-adjustable pneumatic tool that may change output torque by simple operation.

The torque-adjustable pneumatic tool comprises a body, a trigger assembly, and a torque-adjusting module. The body has a trigger chamber, an inlet tunnel, and an outlet tunnel. The inlet tunnel and the outlet tunnel are separated from each other and communicate with the trigger chamber. The trigger assembly is mounted in the trigger chamber and has a button that may be pressed to make the trigger assembly communicate with the inlet tunnel and the outlet tunnel, respectively. The torque-adjusting module is mounted to the body, communicates with the outlet tunnel, and has a silencer, an adjusting bolt, and a piston lid. The silencer has a recess and an exhaust portion communicating with the recess. The exhaust portion has a threaded hole and at least one exhaust hole that are separately disposed through the exhaust portion. The adjusting bolt is movably mounted to the threaded hole of the silencer from a side, which is defined away from the body, of the threaded hole, and engages with the silencer through threads. The piston lid is fixed to the adjusting bolt and is able to enter the recess.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
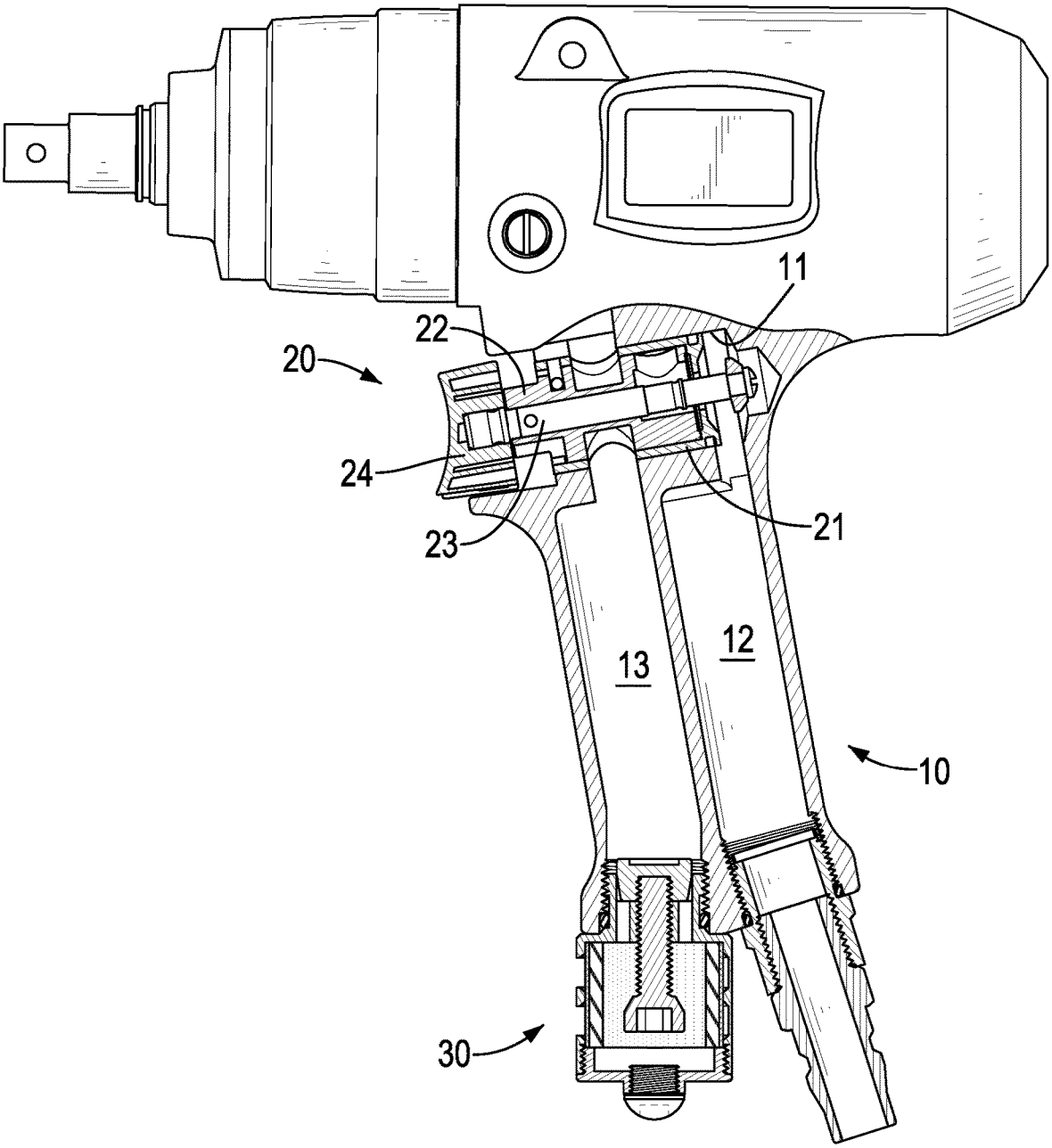
FIG. 1 is a partially cross sectional side view of a first embodiment of a torque-adjustable pneumatic tool in accordance with the present invention.

With reference to FIG. 1, a first embodiment of a torque-adjustable pneumatic tool in accordance with the present invention comprises a body 10, a trigger assembly 20, and a torque-adjusting module 30.

A side of the body 10 that is toward the left side of the FIG. 1 is defined as a front side, and thus an opposite side of the body 10 is defined as a rear side. Being connected to an air compressor, the body 10 has a trigger chamber 11, an inlet tunnel 12, and an outlet tunnel 13. The trigger chamber 11 is disposed in a middle portion of the body 10, and communicates with a chamber in which an air motor is located. The inlet tunnel 12 is disposed inside the body 10 near the rear side, and communicates with the trigger chamber 11. The outlet tunnel 13 is disposed inside the body 10 near the front side of the body 10, is separated from the inlet tunnel 12, and communicates with the trigger chamber 11.

The trigger assembly 20 is mounted with the body 10 and protrudes toward the front side of the body 10. The trigger assembly 20 comprises a valve sleeve 21, a valve core 22, a piston pin 23, and a button 24. The valve sleeve 21 is mounted in the chamber 11 and has an opening toward the front side of the body 10. The valve core 22 is mounted in the valve sleeve 21. The piston pin 23 is back-and-forth movably mounted with the valve core 22. A rear end of the piston pin 23 protrudes on a rear side of the valve sleeve 21, and a front end of the piston pin 23 protrudes on the front side of the body 10. The button 24 is mounted on the front end of the piston pin 23 so that a user may push the piston pin 23 via the button 24. The piston pin 23 being pushed will move backwardly, and thus compressed air may flow through the valve sleeve 21 from the inlet tunnel 12, enter the chamber 11 to drive the air motor, and pass the valve sleeve 21 once again to flow into the outlet tunnel 13.

Figure 2:
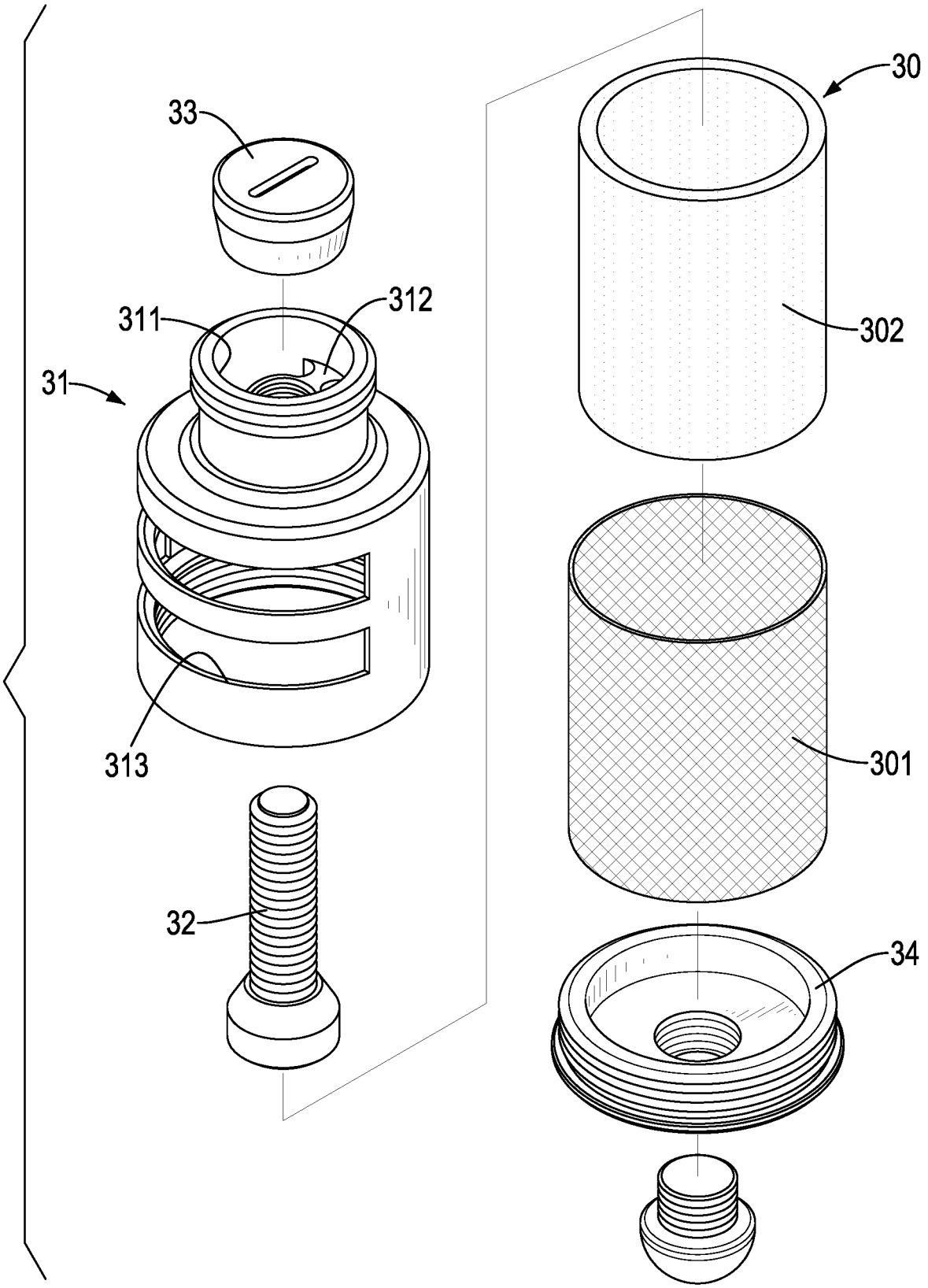
FIG. 2 is an exploded perspective view of a torque-adjusting module of the torque-adjustable pneumatic tool in FIG. 1.

With reference to FIGS. 1 and 2, the torque-adjusting module 30 is mounted to the body 10, and communicates with the outlet tunnel 13. The torque-adjusting module 30 has a silencer 31, an adjusting bolt 32, a piston lid 33, and a cover 34. The silencer 31 is mounted on a bottom of the body 10, and communicates with the outlet tunnel 13.

Figure 3A:
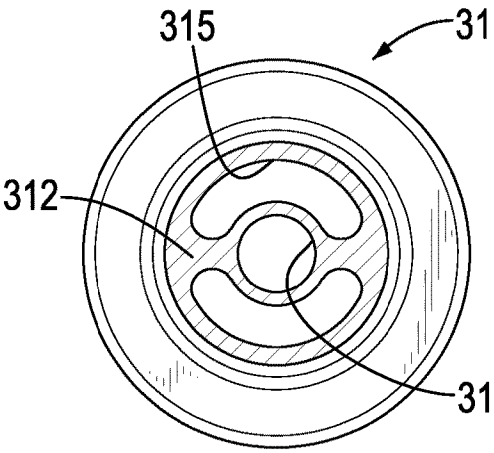
FIGS. 3A to 3F are vertical views of six configurations of a silencer of the torque-adjusting module in FIG. 2.
Figure 3B:
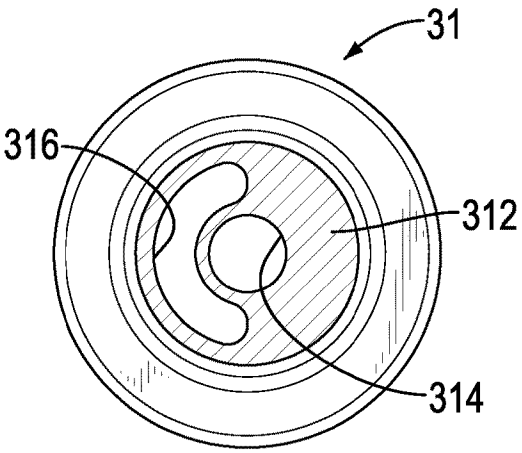
Figure 3C:
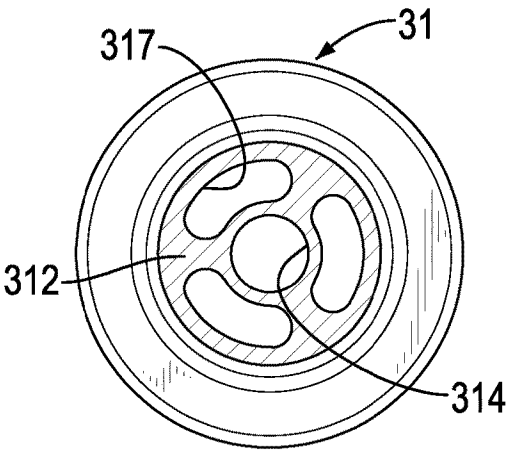
Figure 3D:
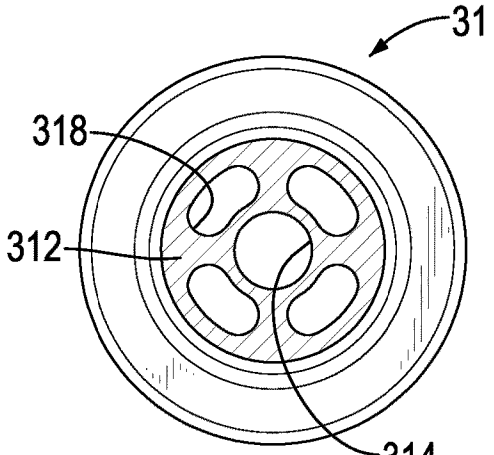
Figure 3E:
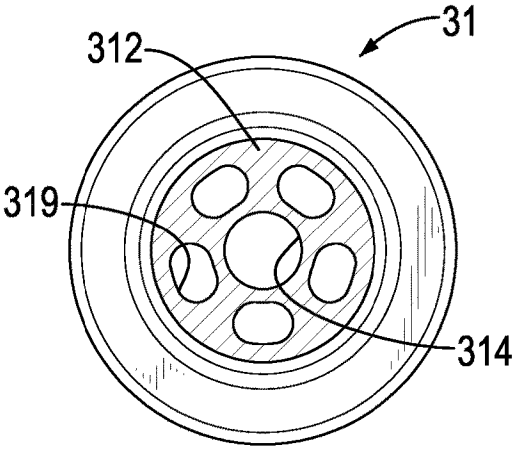
Figure 3F:
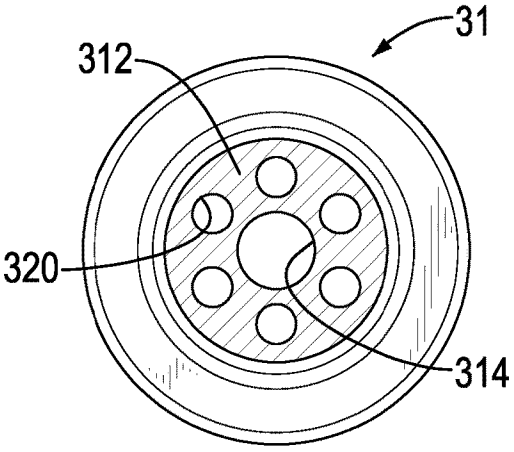

The silencer 31 has a hollow net hoop 301, a noise absorber 302, a recess 311, an exhaust portion 312, and multiple through holes 313. The net hoop 301 and the noise absorber 302 are located in the silencer 31. The recess 311 is recessed from a top of the silencer 31. With reference to FIGS. 1 and 3A, the exhaust portion 312 is formed under the roove recess 311. The exhaust portion 312 has a threaded hole 314 and two exhaust holes 315. The threaded hole 314 is disposed axially through a center of the exhaust portion 312. The two exhaust holes 315 are disposed axially through the exhaust portion 312 at a spaced interval, and areas above and below the exhaust portion 312 communicate with each other via the two exhaust holes 315. The multiple through holes 313 are disposed through a side wall of the silencer 31 so that air in the outlet tunnel 13 may be exhausted via the through holes 313. Additionally, with reference to FIGS. 3A to 3F, the exhaust portion 312 has at least one exhaust hole. In FIG. 3B, the exhaust portion 312 has one exhaust hole 316, and in FIGS. 3C to 3F, the exhaust portion 312 has multiple exhaust holes 315, 317, 318, 319, 320.

With reference to FIGS. 1 and 2, the adjusting bolt 32 is upwardly inserted into and mounted in the threaded hole 314 of the silencer 31 and engages with the silencer 31 through threads. The piston lid 33 is fixed on a top of the adjusting bolt 32. As the adjusting bolt 32 moves downwardly, the piston lid 33 is received in the recess 311 and abuts the exhaust portion 312. The cover 34 is mounted with the silencer 31 and shelters a bottom end of the silencer 31. The cover 34 has an operating hole aligning with the adjusting bolt 32, so the user may put a screw driver into the torque-adjusting module 30 to screw the adjusting bolt 32. Except when the adjustment is being processed, a bolt is mounted in the operating hole.

Figure 4:
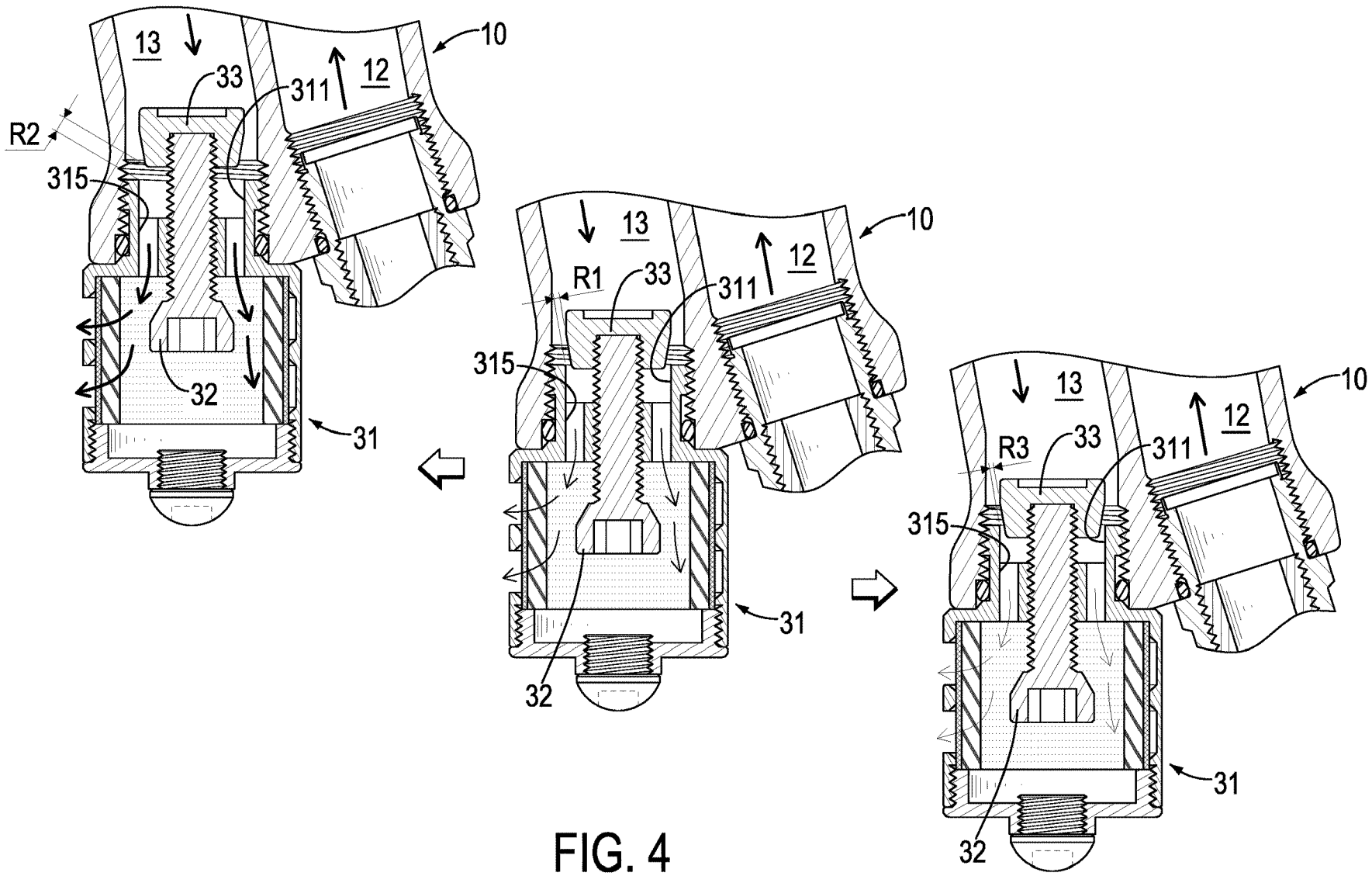
FIG. 4 shows operational views of changing an R value of the torque-adjustable pneumatic tool in FIG. 1.
Figure 5:
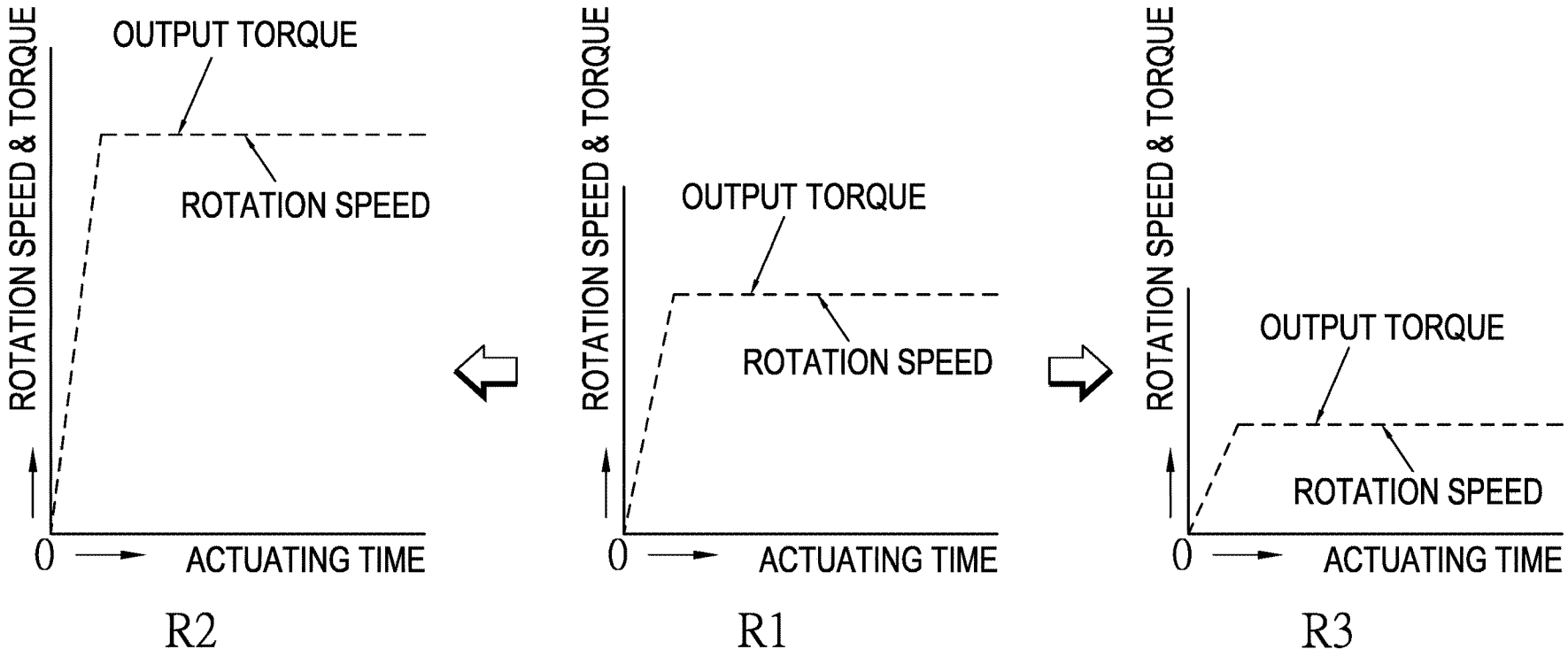
FIG. 5 shows curve plots of value variations of rotation speed and torque in time according to different R values in FIG. 4.

With reference to FIGS. 4 and 5, an R value is introduced to express the value of an interval between the piston lid 33 and a top of the recess 311. By the aforementioned adjustment of the adjusting bolt 32, the user may change the location of the piston lid 33 relative to the recess 311, and further changes the R value.

When the adjusting bolt 32 is screwed upwardly into the recess 311, the piston lid 33 moves away from the silencer 31, and the R value of the torque-adjusting module 30 is turned from R1 into R2. The air compressor keeps supplying compressed air under the same pressure, yet the exhaust amount of the body 10 has been increased. Pressure difference between the inlet tunnel 12 and the outlet tunnel 13 becomes larger, and consequently the compressed air flows faster in the body 10. As a result, the rotation speed and the torque of the air motor driven by the compressed air rise.

When the adjusting bolt 32 is screwed downwardly, the piston lid 33 is thereby pulled toward the recess 311, and the R value is turned from R1 into R3. The exhaust amount of the body 10 has thus been decreased. Pressure difference between the inlet tunnel 12 and the outlet tunnel 13 becomes smaller, and consequently the compressed air flows slower in the body 10. As a result, the rotation speed and the torque of the air motor driven by the compressed air fall.

Figure 6:
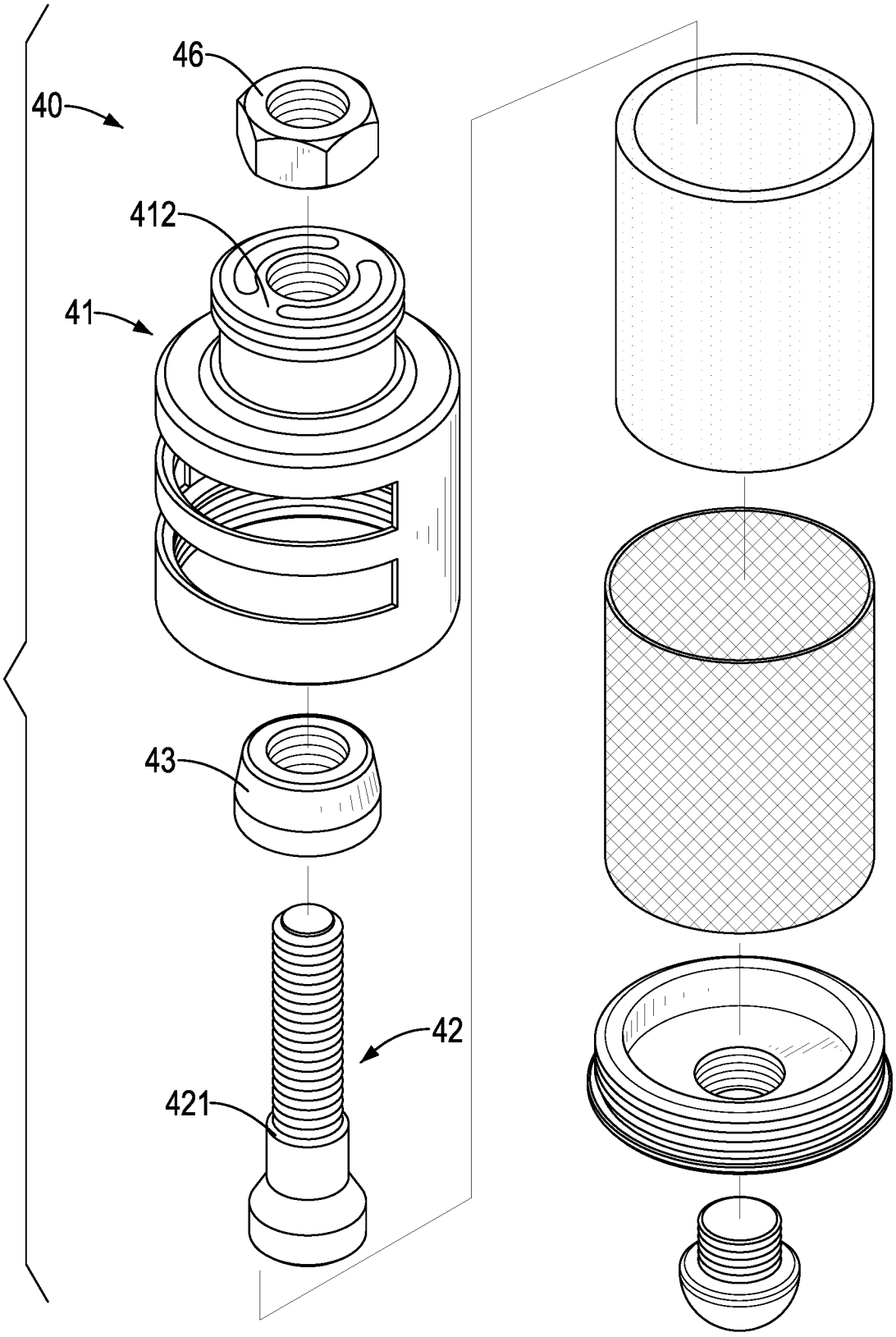
FIG. 6 is an exploded perspective view of a torque-adjusting module of a second embodiment of a torque-adjustable pneumatic tool in accordance with the present invention.
Figure 8:
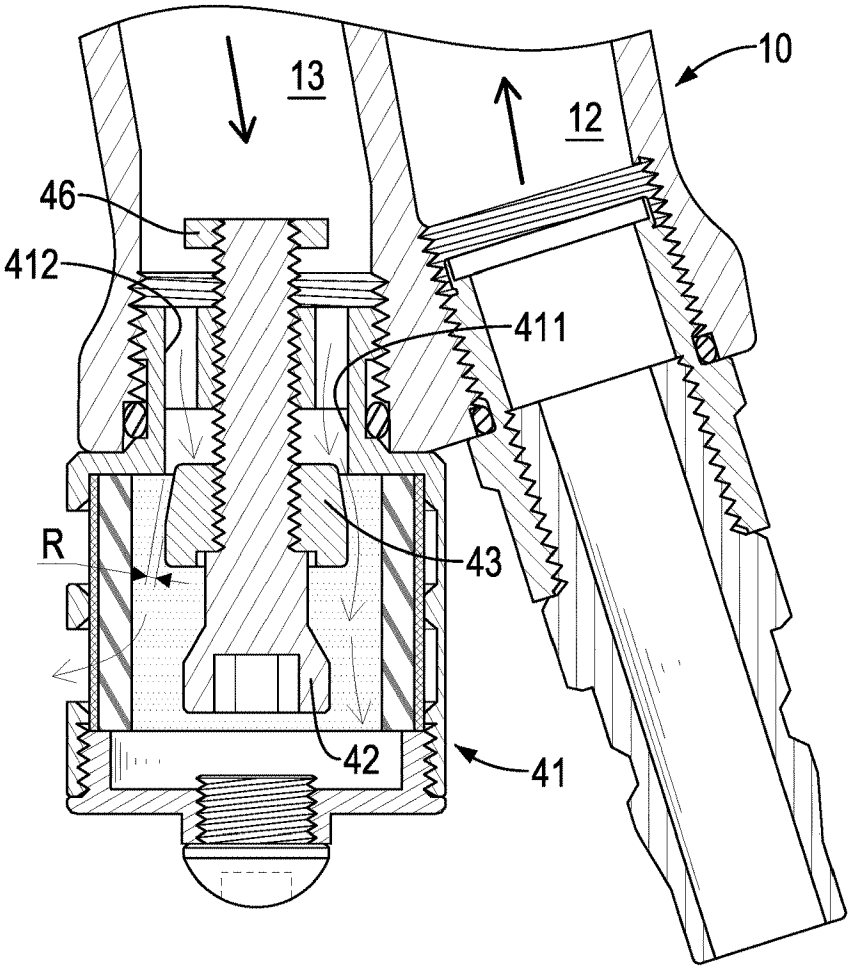
FIGS. 7 and 8 are enlarged cross sectional views in different R values of the torque-adjustable pneumatic tool in FIG. 6.
Figure 7:
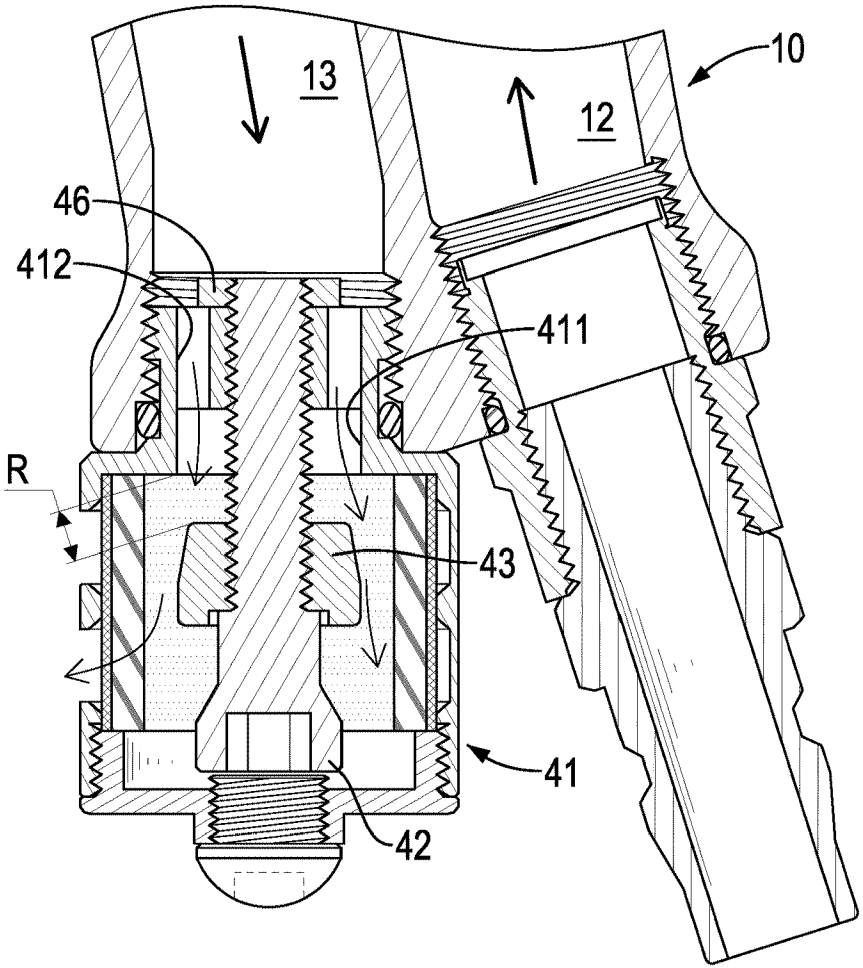

With reference to FIGS. 6 to 8, in a second embodiment of a torque-adjustable pneumatic tool of the present invention, the torque-adjusting module 40 comprises an abutting nut 46. The recess 411 is disposed in the silencer 41 and has a downward opening. The exhaust portion 412 is formed on a top side the recess 411. The adjusting bolt 42 has a limiting portion 421. The piston lid 43 is fixed with the adjusting bolt 42, abuts the limiting portion 421, and is thereby able to move relative to the recess 411 in the silencer 41. The abutting nut 46 is fixed on a top end of the adjusting bolt 42. When the adjusting bolt 42 is screwed down to a lowest position, the abutting nut 46 abuts the exhaust portion 412.

According to the above description, the second embodiment differs from the first embodiment in the positional relationship between the piston lid 43 and the exhaust portion 412. When the adjusting bolt 42 is screwed downwardly, the piston lid 43 moves away from the recess 411, and causes increase of the R value. Amount of air exhaustion of the body 10 rises, and rotation speed along with torque become larger as well. On the other hand, when the adjusting bolt is screwed upwardly, the piston lid 43 moves into the recess 411, and causes decrease of the R value. Amount of air exhaustion of the body 10 falls, and rotation speed along with torque becomes smaller as well. That is, positive relationship between the R value and the rotation speed and the torque is identical to that in the first embodiment.

Figure 9:
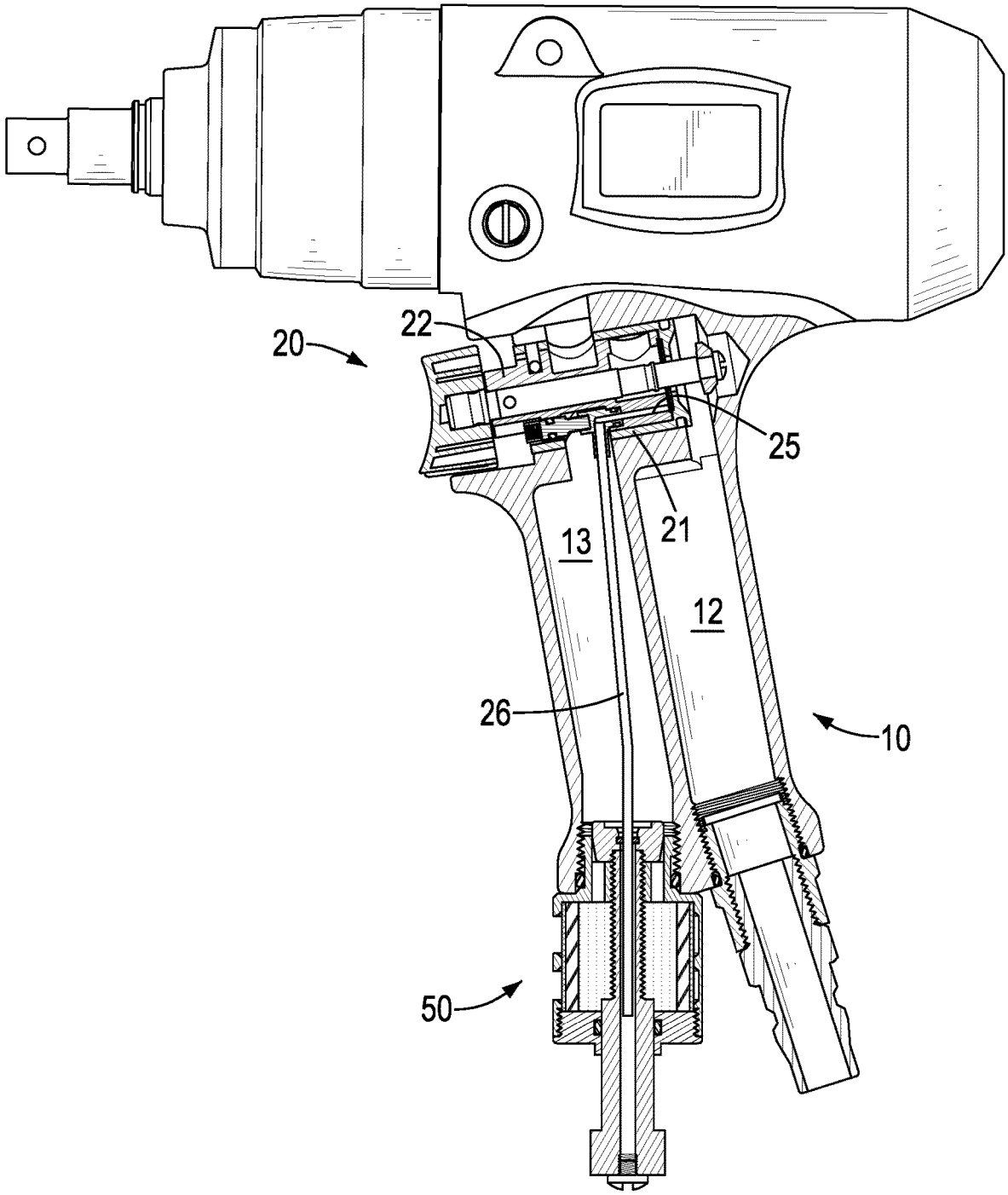
FIG. 9 is a partially cross sectional side view of a third embodiment of a torque-adjustable pneumatic tool in accordance with the present invention.
Figure 10:
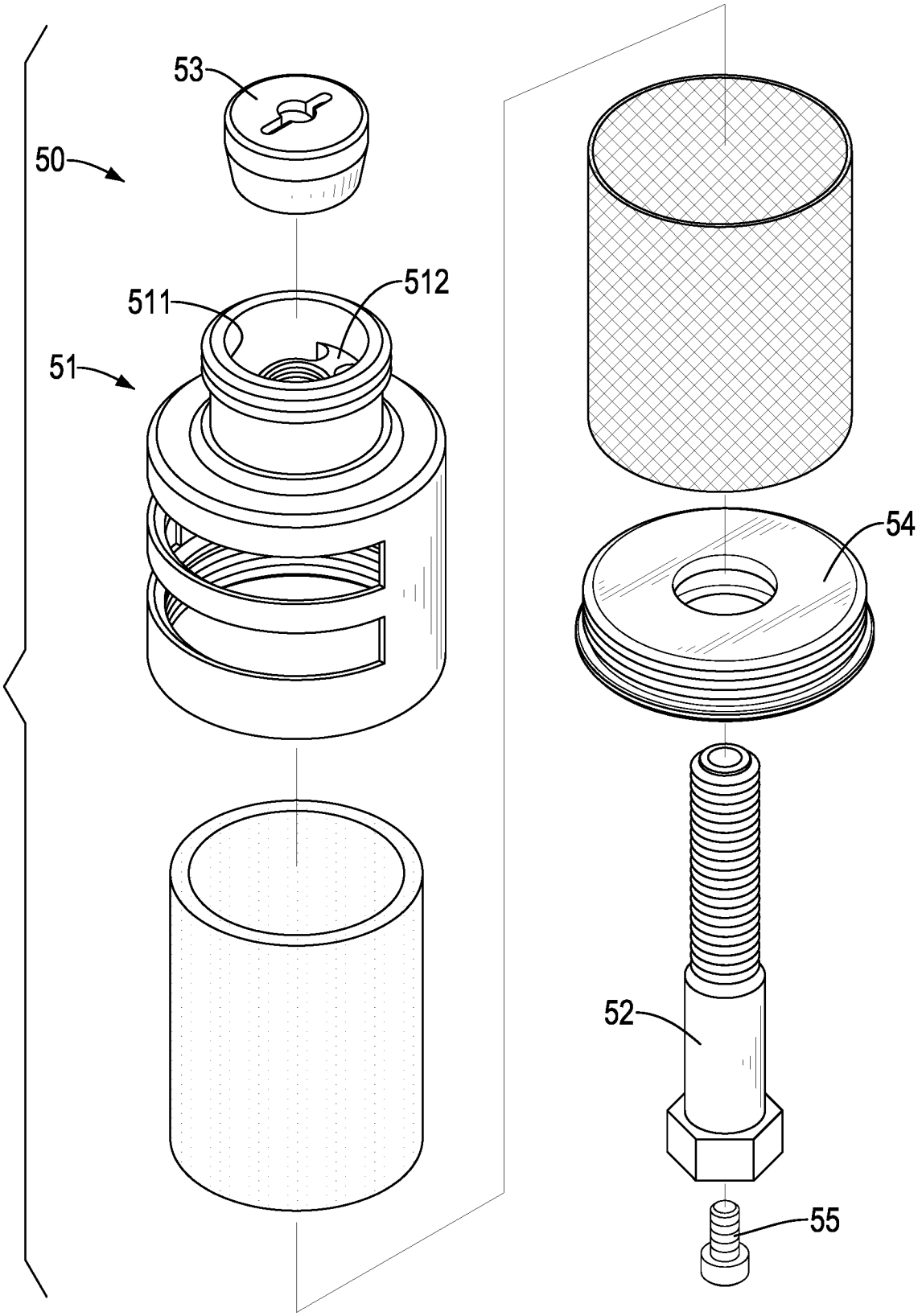
FIG. 10 is an exploded perspective view of a torque-adjusting module of the torque-adjustable pneumatic tool in FIG. 9.

With reference to FIGS. 9 and 10, a third embodiment of a torque-adjustable pneumatic tool of the present invention differs from the first embodiment in two features. First, the trigger assembly 20 has a signal tunnel 25 and a guiding tube 26. The signal tunnel 25 is formed between the valve sleeve 21 and the valve core 22, and is located on a bottom of the valve core 22 near the rear side. The guiding tube 26 is located in the outlet tunnel 13, and communicates with the signal tunnel 25. Part of the compressed air in the inlet tunnel 12 will directly flow into the signal tunnel 25 and the guiding tube 26 without entering the chamber of the air motor, so the signal tunnel 25 and the guiding tube 26 may offer a pneumatic signal. The pneumatic signal is applied to an exterior device.

Figure 11:
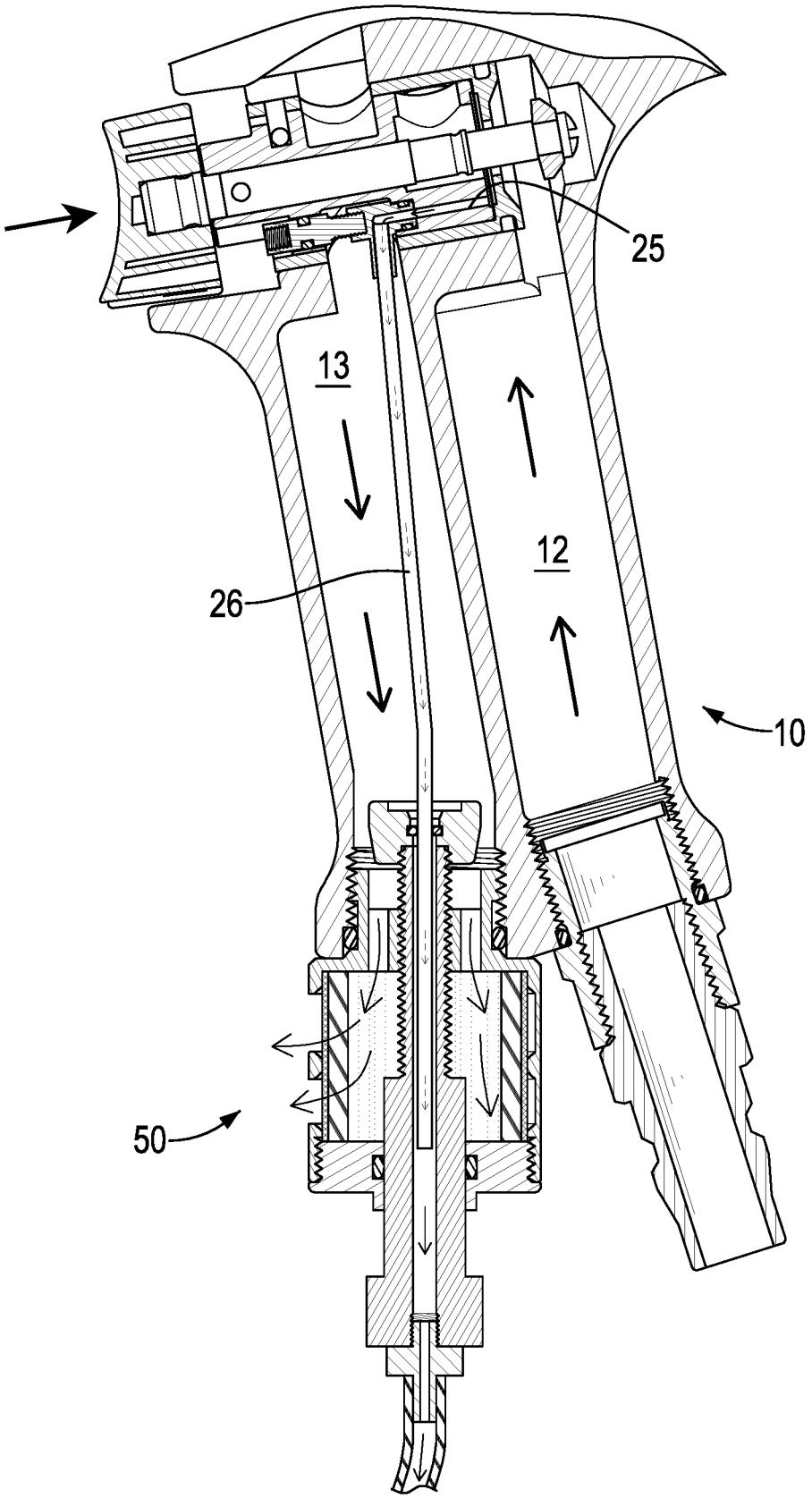
FIGS. 11 to 13 are enlarged cross sectional side views in different R values of the torque-adjustable pneumatic tool in FIG. 9.
Figure 12:
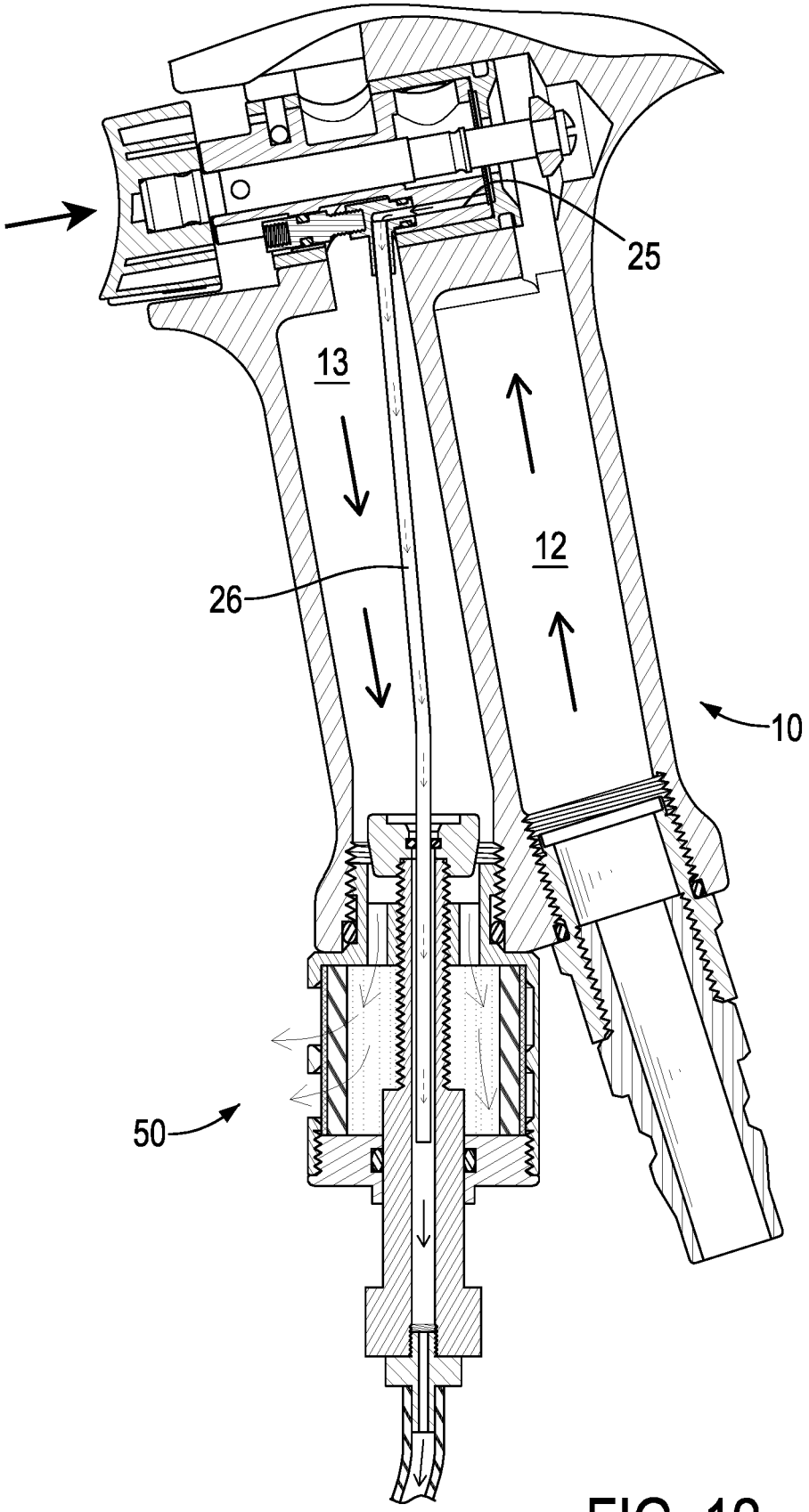
Figure 13:
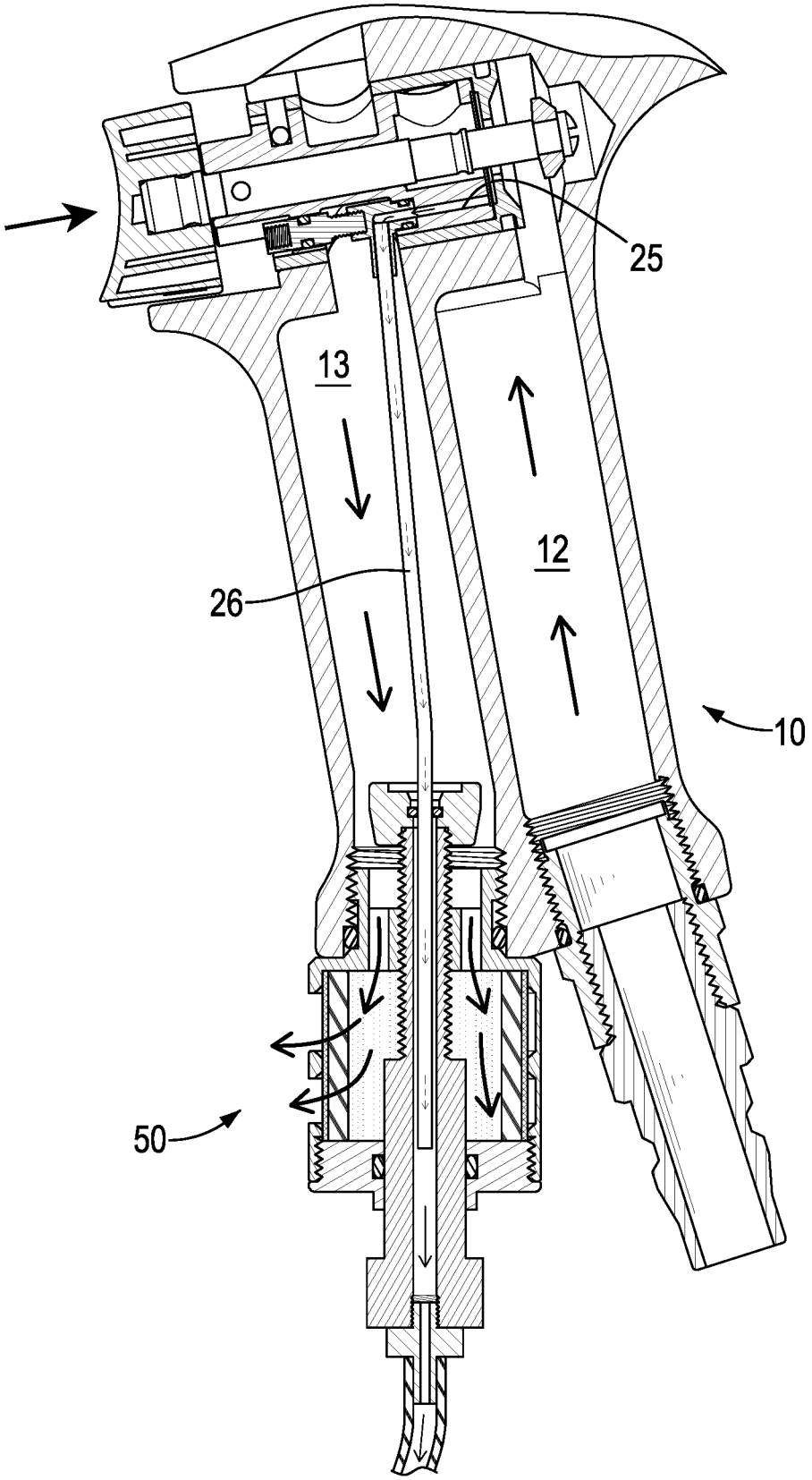

Second, the adjusting bolt 52 of the torque-adjusting module 50 penetrates the cover 54, and is movably mounted to the silencer 51. The adjusting bolt 52 and the piston lid 53 are axially hollow and mutually communicating. The guiding tube 26 passes through the piston lid 53 and is inserted into the adjusting bolt 52, so the pneumatic signal may be transmitted through the adjusting bolt 52. The exterior device is connected to the adjusting bolt 52, so that the pneumatic signal may be inputted to the exterior device. The exterior device may be a counter, a pressure gauge, or other devices that work with pneumatic signals. For instance, if the counter is connected to the adjusting bolt 52, every time when the user presses the button 24, a signal will be transmitted to the counter, and the total pressing times may be counted. Besides, if the pressure gauge is connected to the adjusting bolt 52, pressure of compressed air may be measured. Therefore, with reference to FIGS. 11 to 13, the user may instantly screw the adjusting bolt 52 to change the R value of the torque-adjusting module 50, for further adjustment to the pressure to provide demanded torque.

Moreover, the torque-adjusting module 50 optionally comprises a blocking bolt 55. The blocking bolt 55 is mounted on and seals a bottom end of the adjusting bolt 52, when no exterior device is connected to the adjusting bolt 52. In this case, the third embodiment is functionally identical to the first embodiment of the present invention.

Figure 14:
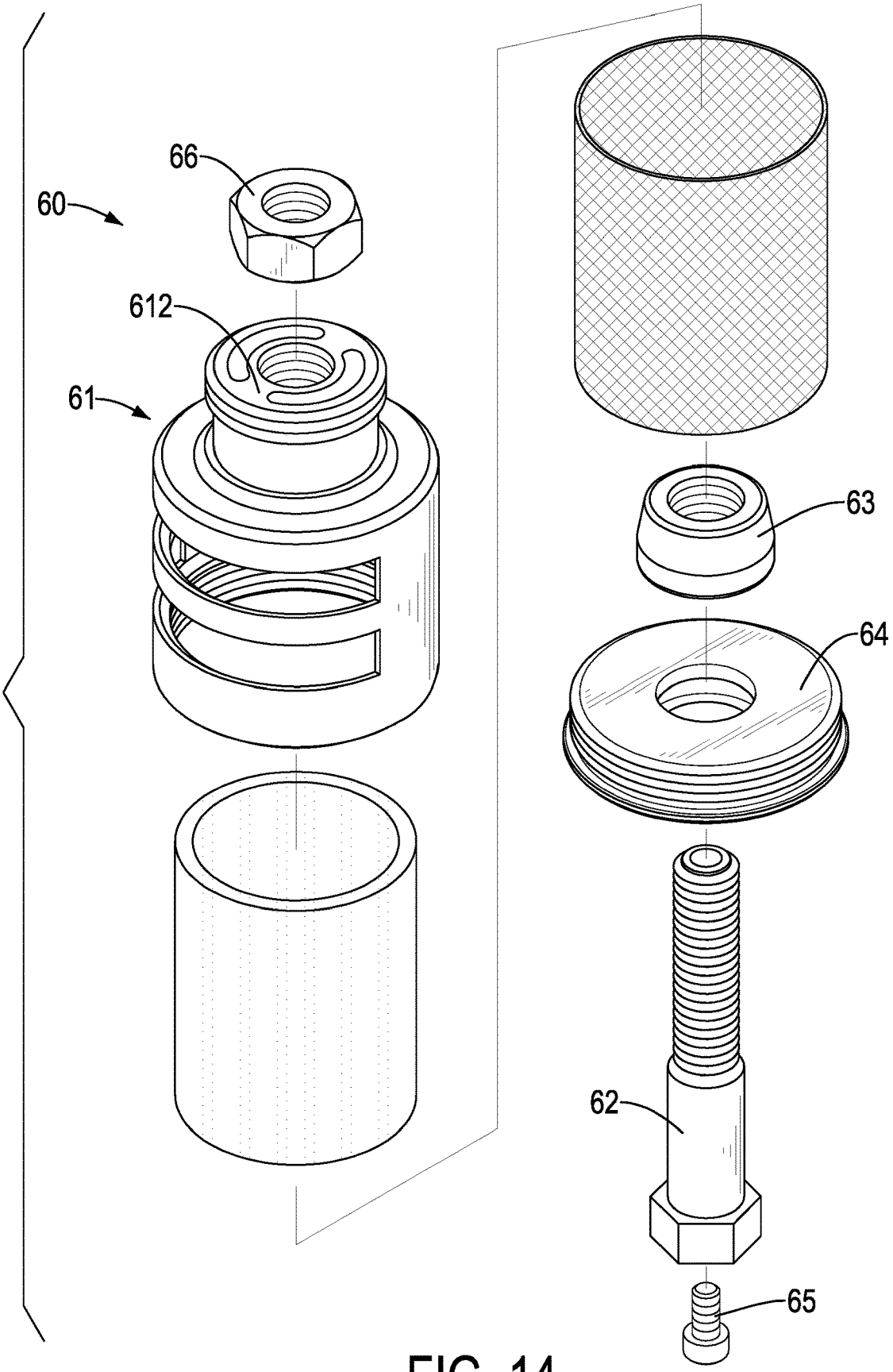
FIG. 14 is an exploded perspective view of a torque-adjusting module of a fourth embodiment of a torque-adjustable pneumatic tool in accordance with the present invention.
Figure 15:
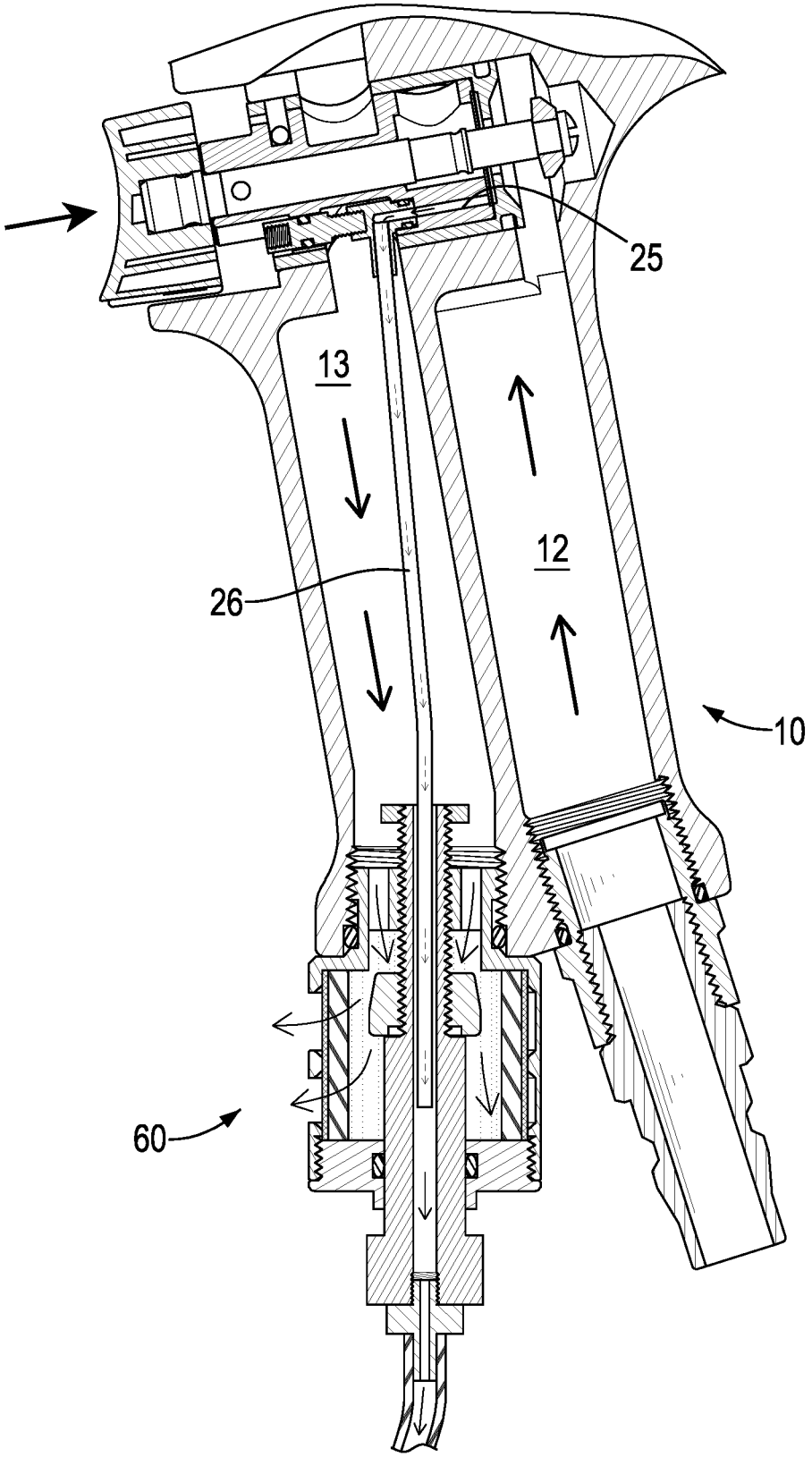
FIG. 15 is an enlarged cross sectional side view of the torque-adjustable pneumatic tool in FIG. 14.
Figure 16:
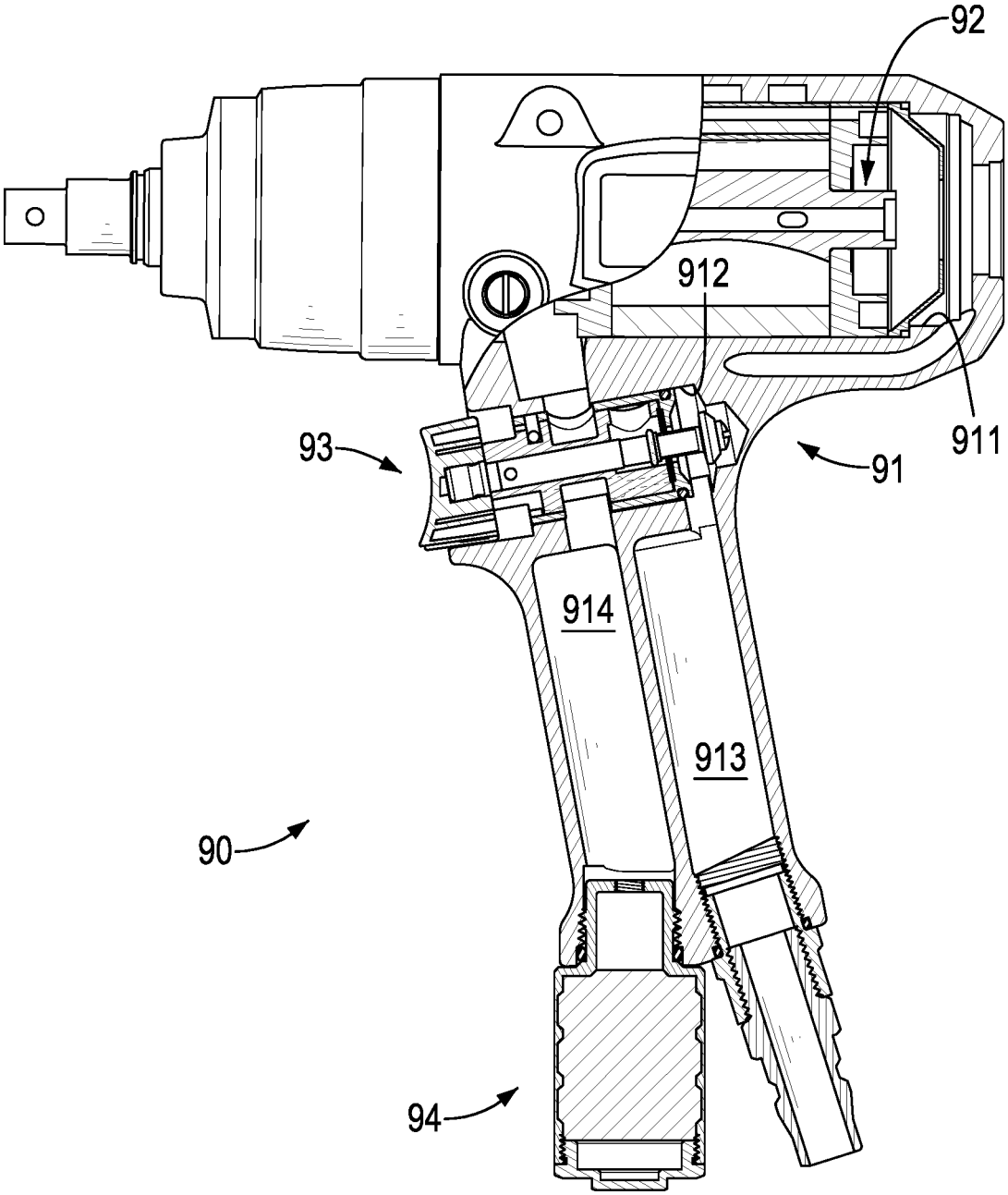
FIG. 16 PRIOR ART
FIG. 16 is a partially cross sectional side view of a pneumatic tool in accordance with the prior art.

With reference to FIGS. 14 and 15, a fourth embodiment of a torque-adjustable pneumatic tool of the present invention differs from the third embodiment in the positional relationship between the piston lid 63 and the exhaust portion 612. An abutting nut 66 is fixed to a top end of the adjusting bolt 62. When the adjusting bolt 62 is disposed at a lowest position, the abutting nut 66 abuts the exhaust portion 612 to provide a position restriction. As shown in FIG. 15, an exterior device may be connected to the adjusting bolt 62. The user may change the R value of the torque-adjusting module 60 by the same operating process as in the second embodiment, in order to process instant adjustment to the rotation speed and torque.

With the aforementioned technical characteristics, the torque-adjustable pneumatic tool of the present invention has the following advantages.

1. The torque-adjusting modules 30, 40, 50, 60 provide the user with a simple way to process an instant adjustment to the rotation speed and torque of the air motor of the torque-adjustable pneumatic tool. The shortcoming of the prior art is thereby overcome.

2. The signal tunnel 25 and the guiding tube 26 produce a pneumatic signal that may provide the user with some useful information such as total pressing times or instant air pressure.

What is claimed is:

1. A torque-adjustable pneumatic tool comprising:

a body having a trigger chamber;

an inlet tunnel; and an outlet tunnel;

wherein the inlet tunnel and the outlet tunnel are separated from each other and communicate with the trigger chamber;

a trigger assembly mounted in the trigger chamber and having a button that may be pressed to make the trigger assembly communicate with the inlet tunnel and the outlet tunnel, respectively; and a torque-adjusting module mounted to the body, communicating with the outlet tunnel, and having a silencer having a recess; and an exhaust portion communicating with the recess and having a threaded hole disposed through the exhaust portion; and at least one exhaust hole disposed through the exhaust portion and spaced from the threaded hole;

an adjusting bolt movably mounted to the threaded hole of the silencer from a side, which is defined away from the body, of the threaded hole, and engaging with the silencer through threads; and a piston lid fixed to the adjusting bolt and being able to enter the recess.

2. The torque-adjustable pneumatic tool as claimed in claim 1, wherein the recess is disposed on a top side of the silencer;

the exhaust portion is located under the recess; and the piston lid is located above the exhaust portion.

3. The torque-adjustable pneumatic tool as claimed in claim 1, wherein the exhaust portion is located on a top side of the recess;

the piston lid is located below the exhaust portion; and the torque-adjusting module has an abutting nut fixed to a top end of the adjusting bolt above the exhaust portion.

4. The torque-adjustable pneumatic tool as claimed in claim 1, wherein the trigger assembly comprises a valve sleeve mounted in the trigger chamber;

a valve core mounted in the valve sleeve;

a signal tunnel formed between the valve sleeve and the valve core and communicating with the inlet tunnel when the button is pressed; and a guiding tube located in the outlet tunnel and communicating with the signal tunnel.

5. The torque-adjustable pneumatic tool as claimed in claim 4, wherein the recess is disposed on a top side of the silencer;

the exhaust portion is located under the recess; and the piston lid is located above the exhaust portion.

6. The torque-adjustable pneumatic tool as claimed in claim 5, wherein the adjusting bolt and the piston lid are hollow and mutually communicating, and a bottom end of the guiding tube passes through the piston lid and is inserted into the adjusting bolt.

7. The torque-adjustable pneumatic tool as claimed in claim 4, wherein the exhaust portion is located on a top side of the recess;

the piston lid is located below the exhaust portion; and the torque-adjusting module has an abutting nut fixed to a top end of the adjusting bolt above the exhaust portion.

8. The torque-adjustable pneumatic tool as claimed in claim 7, wherein the adjusting bolt and the piston lid are hollow and mutually communicating, and a bottom end of the guiding tube passes through the piston lid and is inserted into the adjusting bolt.

* * * * *